US011241804B2

(12) United States Patent
Godlieb

(10) Patent No.: US 11,241,804 B2
(45) Date of Patent: Feb. 8, 2022

(54) SHAVING UNIT WITH LUBRICATING ARRANGEMENT

(71) Applicant: KONINKLIJKE PHILIPS N.V., Eindhoven (NL)

(72) Inventor: Robert Godlieb, Drachten (NL)

(73) Assignee: KONINKLUKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/052,550

(22) PCT Filed: May 8, 2019

(86) PCT No.: PCT/EP2019/061772
§ 371 (c)(1),
(2) Date: Nov. 3, 2020

(87) PCT Pub. No.: WO2019/219467
PCT Pub. Date: Nov. 21, 2019

(65) Prior Publication Data

US 2021/0245375 A1 Aug. 12, 2021

(30) Foreign Application Priority Data

May 16, 2018 (EP) ..... 18172533

(51) Int. Cl.
*B26B 19/40* (2006.01)
*B26B 19/16* (2006.01)

(52) U.S. Cl.
CPC ..... *B26B 19/40* (2013.01); *B26B 19/16* (2013.01)

(58) Field of Classification Search
CPC ..... B26B 19/40; B26B 19/16
See application file for complete search history.

(56) References Cited

U.S. PATENT DOCUMENTS 2,216,994 A 10/1940 Wall
2,270,800 A 1/1942 Johnson
(Continued)

FOREIGN PATENT DOCUMENTS

GB 545830 6/1942
JP S59129089 A 7/1984
(Continued)

OTHER PUBLICATIONS

International Search Report and Written Opinion dated Aug. 1, 2019 for International Application No. PCT/EP2019/061772 Filed May 8, 2019.

*Primary Examiner* — Omar Flores Sanchez

(57) ABSTRACT

A shaving unit (16) is disclosed comprising a housing (12), a guard (20) stationary relative to the housing (12), a cutting edge (22) arranged at a distance from the guard (20) and stationary relative to the housing, a hair-entry opening bounded by the guard and the cutting edge, and a drum (24) arranged within the housing, the drum (24) being configured to be driven rotatingly about a longitudinal axis thereof. A plurality of counter cutting edges (28) is arranged on the drum (24), wherein the counter cutting edges (28) cooperate with the cutting edge (22) during rotation of the drum (24) about the longitudinal axis (26) for shearing or cutting hairs when the shaving unit (16) is moved over a skin (30). The shaving unit (16) further comprises a lubricating arrangement (36) with a liquid reservoir (38) filled with a lubricant and with a feed mechanism (41) for supplying the lubricant from the liquid reservoir (38) to at least one of the counter cutting edges (28) for providing a lubricating film (42) thereto. The feed mechanism (41) comprises a lubricating element (39) arranged adjacent to the drum (24) in a position such as to engage the at least one counter cutting edge (28)
(Continued)

during rotation of the drum (24) about the longitudinal axis (26).

17 Claims, 4 Drawing Sheets

(56) References Cited

U.S. PATENT DOCUMENTS

| | | | | |
|---|---|---|---|---|
| 2,335,607 | A | 11/1943 | Penney | |
| 2,600,880 | A | 6/1952 | Karle | |
| 4,031,618 | A * | 6/1977 | Mansfield | B26B 19/40 30/41.5 |
| 4,170,821 | A | 10/1979 | Booth | |
| 4,850,107 | A | 7/1989 | Valliades | |
| 5,072,512 | A | 12/1991 | Noijjain | |
| 6,895,673 | B2 | 5/2005 | O | |
| 9,156,175 | B2 | 10/2015 | Wain | |
| 9,375,856 | B2 | 6/2016 | Bennik | |
| 10,889,016 | B2 * | 1/2021 | Davos | B26B 19/16 |
| 2005/0138814 | A1 | 6/2005 | Pennella | |
| 2021/0227948 | A1 * | 7/2021 | Kuo | A45D 34/041 |

FOREIGN PATENT DOCUMENTS

| | | |
|---|---|---|
| WO | 1998008660 | 3/1998 |
| WO | 2011/036577 | 3/2011 |
| WO | 2011/073906 | 6/2011 |
| WO | 2014/191844 | 12/2014 |
| WO | 2015/128181 | 9/2015 |

* cited by examiner

SHAVING UNIT WITH LUBRICATING ARRANGEMENT

CROSS REFERENCE TO RELATED APPLICATIONS

This application is the U.S. National Phase application under 35 U.S.C. § 371 of International Application No. PCT/EP2019/061772 filed May 8, 2019, which claims the benefit of European Patent Application Number 181723533.4 filed May 16, 2018. These applications are hereby incorporated by reference herein.

FIELD OF THE INVENTION

The present invention relates to a shaving unit with a rotary cutter that is configured with a lubrication. The present invention further relates to a shaving appliance comprising a shaving unit.

During shaving friction may be irritating and is not desired. For this reason, shaving units with features have been designed to reduce friction of a shaving unit on a user's skin.

BACKGROUND OF THE INVENTION

U.S. Pat. No. 2,600,880 A discloses a moisture pad in front of a blade edge on a manually operated razor.

Other razors including features for reducing friction are known from U.S. Pat. No. 2,600,880 A and from U.S. 4,170,821.

Razors with drum cutter are well known in the art, such as from U.S. Pat. No. 489,995 A or from U.S. Pat. No. 2,216,994 A. However, there is no lubrication provided.

According to WO 2015/128181 A1 a shaving unit with two drum cutters is known that are arranged parallel to each other. However, there is no lubrication provided.

According to WO 2014/191844 A2 a shaving unit comprises a rotary cutter having a lubricating element coupled thereto. The cutting unit comprises a rotary cutter configured as a drum with a plurality of cut-outs that cooperate with a fixed blade for cutting hair. At the outer surface of the drum a plurality of lubricating elements that may comprise fibrous material soaked with lubricant are arranged. The lubricating elements may be fluidly connected with a fluid reservoir for further fluid supply. Also a backfill solution may be provided to manually or automatically replace fluid lost by the lubricating elements from the fluid reservoir.

However, the known shaving unit is not effective. As the lubricant is placed in the same smooth drum surface that is used for the cutting, the lubricant is rapidly "shaved off" by the static cutting blade. Consequently, it will be rapidly exhausted or made ineffective. In addition, the lubricant is not very effective for skin comfort. When lubricant is applied to the lubricant elements in the drum, the static blade will shave off the lubricant. When the drum next touches the skin, it will be "dry". To allow the lubricant to leach out towards the skin, it will need contact with a pliant, wet skin. Since it needs lubricant before it touches the skin, which is not the case in this embodiment, the discomfort will already be caused. Also with the backfill solution that allows to further supply lubricant from the reservoir to the lubricating elements either manually or automatically, the effect of "shaving-off" the lubricant is not avoided. Still is makes things even more complicated.

From U.S. Pat. No. 9,156,175 B2 a fluid dispensing cartridge for a personal care appliance with a fluid applicator having a baffle with a rear wall and an opposing resilient front flap is known. The baffle defines at least one outlet port. The resilient front flap contacts the portion of the rear wall in a first position and is spaced apart from the portion in a second position. The fluid dispenser includes a plurality of elongated recesses extending parallel to the blade edge and supplies fluid onto the guard or skin in front of the blade. However, there is shown no application in connection with a rotary cutter.

U.S. Pat. No. 2,270,800 A discloses an electric razor with a rotary cutter. The razor includes an oiling wick with oil ducts leading to the rotor cutter, and further includes a felt seal and oil ducts leading to the motor shaft. A spiral drum-cutter is totally encased in an outer tubular stator guard. The oiling wick is used for oiling the journal bearing of the rotor cutter in the stator guard and other parts of the cutter as was common for electric shavers at this time.

Although in the known razor there is provided a lubricating arrangement, it is merely used for lubricating the cutter with oil. There is no provision to direct a lubricant to a skin-engaging surface or to a cutting element as such.

WO 98/08660 A1 discloses a razor with a rotary cutter that comprises a separate fluid reservoir from which a lubricant is supplied to the skin to a fluid outlet using a pump. The fluid outlet is separate from the cutter, and the lubricant needs to be dispersed by moving the razor across the skin.

The shaving units according to the prior art having a roller or drum providing the counter cutting edge cooperating with a fixed cutting edge have several significant drawbacks. One of these is the amount of motion applied by the roller on the skin. The skin experiences a relatively high amount of manipulation and sliding action from the roller elements, as it guides the hairs against the cutting edge. This causes a high risk of skin irritation when compared to a conventional cutting edge without such skin-contacting roller. This also causes the risk of not only pressing the hairs in a shearing action against the cutting edge, but also to include skin and cause nicking and pinching of skin.

In view of this there is a need for friction reduction in any active skin manipulating and active sliding system without adversely affecting the overall design of the shaving unit and concomitant skin stretching and skin-flow guiding.

In the prior art a lubricating strip can be applied to the outside of the roller as known from WO 2014/191844 A2 mentioned above. This has the drawback that it compromises the geometry of the skin sliding and engaging surface. Using a fluid supply instead of a lubricant infused matrix or to re-supply a lubricant infused matrix has the disadvantage that it adds complexity in fluid paths onto the rotating member. Either method will need an excess of lubricant to be applied during and after the moment that it is needed to reduce friction. Another problem is that the lubricant on the roller or drum will need to be spaced away from the effective surface, in order to be not removed by the cutting edge.

SUMMARY OF THE INVENTION

In view of this it is an object of the invention to disclose an improved shaving unit overcoming at least some of the drawbacks mentioned above.

According to a first aspect of the invention this object is achieved by a shaving unit comprising:

a housing;

a guard stationary relative to the housing;

a cutting edge arranged at a distance from the guard and stationary relative to the housing;

a hair-entry opening bound by the guard and the cutting edge;

a drum arranged within the housing, the drum being configured to be driven rotatingly about a longitudinal axis thereof;

at least one counter cutting edge arranged on the drum for cooperating with the cutting edge during rotation of the drum about the longitudinal axis for shearing or cutting hairs entering the hair-entry opening; and a lubricating arrangement comprising:

a liquid reservoir configured for receiving a lubricant, and a feed mechanism including a lubricating element arranged adjacent to the drum in a position such as to engage the at least one counter cutting edge during rotation of the drum about the longitudinal axis for providing a lubricating film to the at least one counter cutting edge.

According to the invention there is applied a thin lubricating film continuously to the moving skin-engaging counter cutting edge, by contrast to applying a lubricating film to the skin as known from the prior art. The lubricant is applied to the rapidly moving skin sliding surface area of the counter cutting edge before it contacts the skin, thus replenishing the film immediately before the cutting process between the counter cutting edge and the cutting edge.

According to the invention the term "cutting edge" is to be interpreted as a surface having a radius of curvature enabling hair cutting in co-operation with a counter cutting edge. The cutting edge must be "sharp", to obtain good cutting results. In particular the radius of curvature of the cutting edge is equal to or smaller than 30 micrometers, more preferably equal to or smaller than 20 micrometers, and most preferably equal to or smaller than 15 micrometers. Further the term "counter cutting edge" is to be interpreted as the outer surface of the drum cooperating with the cutting edge and having a radius of curvature adapted to some extent to the radius of curvature of the cutting edge. Usually, there is a plurality of counter cutting edges on the drum. However, it could also be just one counter cutting edge wound around the drum.

According to the invention not the skin is lubricated, but the moving skin-engaging member, namely the counter cutting edge or a plurality of counter cutting edges, are lubricated.

Preferred embodiments of the invention are defined in the dependent claims.

In an embodiment of the invention the position of the lubricating element is such that, during rotation of the drum about the longitudinal axis, the lubricating element engages the at least one counter cutting edge after the counter cutting edge passing the cutting edge and prior to the counter cutting edge contacting the skin after said passing and before next passing the cutting edge.

This offers the advantage that after passing the cutting line between the cutting edge and the counter cutting edge a lubricating film applied to one of the counter cutting edges will remain thereon until contacting the skin. Therefore, it is avoided that the lubricating film is sheared off during the cutting process. Thus the lubricating film will be fresh directly when the cutting edge contacts the skin.

In an embodiment of the invention the liquid reservoir comprises a pad configured for being soaked with the lubricant.

This is a very effective way for storing and transporting the lubricant.

The exposed area can be reduced when compared to the overall reservoir dimensions. The pad extends typically over the entire width of the drum (typically in the order of 32 mm).

In an embodiment of the invention the lubricating element comprises a wick being in contact with the liquid reservoir and configured for being soaked with the lubricant from the liquid reservoir.

In this way the angle of exposure can be limited to a minimum. The wick draws the lubricant out of the connected liquid reservoir. In this case the pad within the liquid reservoir can be dispensed with. However, still a pad may also be used within the liquid reservoir.

In an embodiment of the invention the wick extends from the liquid reservoir towards a path followed by the at least one counter cutting edge during rotation of the drum about the longitudinal axis.

In an embodiment of the invention the wick may be configured as a roll, arranged for rolling on the at least one counter cutting edge.

In an embodiment of the invention the lubricating arrangement comprises a bias spring being arranged for biasing the lubricating element towards the drum.

By the spring bias a sufficient amount of lubricating is facilitated. Naturally, the pad or wick should have a surface engaging the least one counter cutting edge that is stiff and broad enough to avoid that the pad is urged between the cutting edge and the least one counter cutting edge during rotation of the drum.

In an embodiment of the invention the feed mechanism comprises means for regulating a supply of the lubricant depending on a degree of friction between the lubricating element and the at least one counter cutting edge during rotation of the drum.

Thus, an automatic regulation of the lubricant supply can be ensured in a simple way.

In an embodiment of the invention the wick is arranged at an acute angle relative to a tangential direction of the drum at the position where the wick engages the counter cutting edge during rotation of the drum.

When the wick is arranged in this way relative to the at least one counter cutting edge of the rotating drum, the wick functions as a belt break. The friction of the rotating part against the wick deforms the wick and presses it against the rotating part. This will initiate and/or stimulate the flow and transfer of lubricant. When lubricant is released, the friction is reduced, and the pressure of the wick against the rotating member is reduced, thereby reducing the supply of lubricant.

Similarly, the friction of the drum against a resilient or movable part can be used to regulate or open the flow of lubricant.

In an embodiment of the invention the lubricating arrangement further comprises a wick supporting spring for biasing the wick towards the drum.

This helps to regulate the supply of lubricant from the wick onto the drum.

In an embodiment of the invention the lubricating arrangement is configured as a replaceable part that can be removed from the shaving unit and replaced by a new lubricating arrangement by a user of the shaving unit.

Preferably, the lubricating arrangement is part of a replaceable cartridge, preferably a replaceable cartridge comprising the guard or the cutting edge.

Although the guard itself is not necessarily a replaceable part of such a system, it is convenient to replace the guard together with the lubricating arrangement, since the latter is preferably housed within the guard.

This is a simple and easy way for a consumer to always use a shaving unit with sufficient supply of liquid. Similarly other parts of the shaving unit that are subject to wear, such as the drum, can be made replaceable and may be integrated with the lubricating arrangement.

Many variations of the basic concept of the counter cutting edges arranged on the drum cooperating with a fixed cutting edge exist.

For example, the drum may comprise a plurality of counter cutting edges each extending parallel to the longitudinal axis of the drum, or each extending spirally around the longitudinal axis of the drum.

Further the drum may comprise a plurality of counter cutting edges arranged on free-standing catenary or cantilevered structures protruding from the drum.

Further the at least one counter cutting edge may be configured as a ridge arranged on the drum.

Also the counter cutting edges may be edges of apertures of varying shapes in a hollow tube. In addition to counter cutting edges, the drum may include additional features and functions such as skin manipulation, drive-train elements, gearings, etc.

Similarly, the guard element can have a multitude of shapes, as can have the cutting edge and the adjacent cap area.

The guard may be a closed or an open, teethed guard.

To optimize the skin-flow, there may be provided a low friction area on the cap and a relatively higher friction on the guard, as generally known in a conventional shaving unit.

According to another aspect of the invention a shaving appliance is disclosed comprising a shaving unit as mentioned above.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
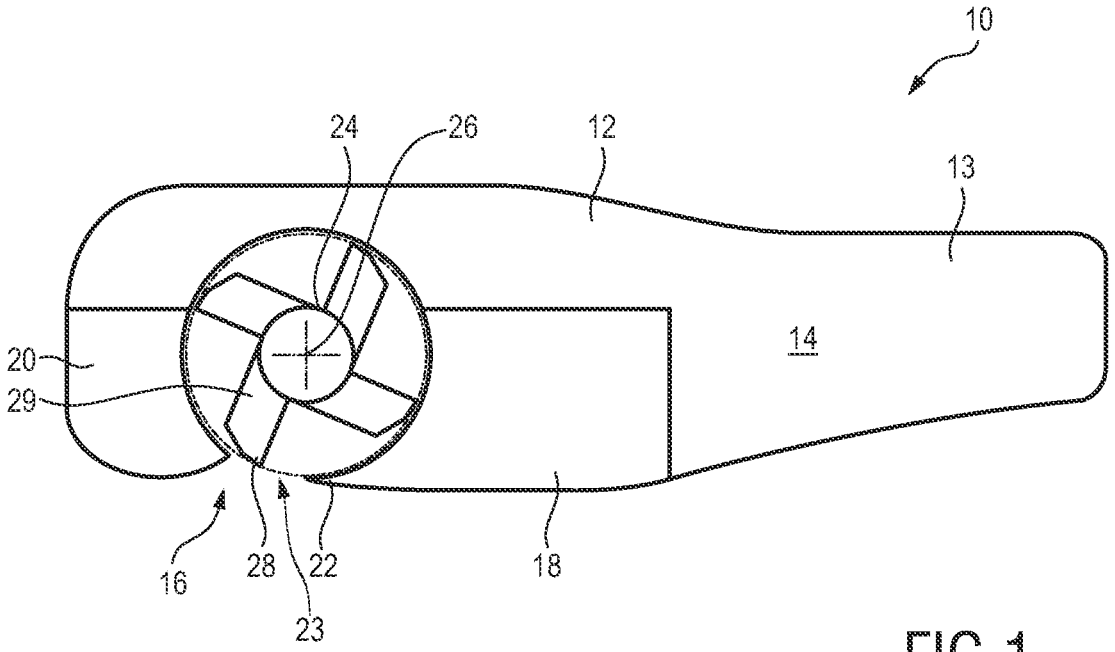
FIG. 1 shows a simplified side view of a shaving appliance including a shaving unit according to the invention, wherein for ease of presentation the drum with the counter cutting edges is shown without the outer housing usually concealing the two axial ends thereof.

In FIG. 1 a shaving appliance is shown configured as a razor and depicted in total with reference numeral 10.

The shaving appliance 10 comprises a housing 12 extending generally in a longitudinal way. The shaving appliance 10 may be held with one hand at a rear part 13 thereof.

According to FIG. 1 the shaving unit 16 basically comprises a guard 20 and a cutting edge 22 stationary within the housing, and a drum 24 carrying four counter cutting edges 28 arranged thereon.

At the lower front end of the housing 12 the guard 20 is arranged that is configured for supporting the cutting edge 22 and to guide the shaving unit 16 over the skin. The cutting edge 22 and the guard define a hair-entry opening 23. The drum 24 is arranged within the cavity bound by the guard 20 and the cutting edge 22 and can be driven rotatingly about a longitudinal axis 26 thereof. At the lower middle part of the housing 12 the cap 18 is arranged.

From the surface of the drum 24 there extend four free-standing wing-like catenary or cantilever structures 29 each having an outer end configured as a counter cutting edge 28. These counter cutting edges 28 cooperate with the cutting edge 22 provided at the end of the cap 18 facing the drum 24 to effect hair cutting or shearing.

In FIG. 1 a drive merely denoted with reference numeral 14 is shown that is configured for driving the drum 24 rotatingly. Further features, such as controls, etc. are not shown for ease of representation.

Figure 2:
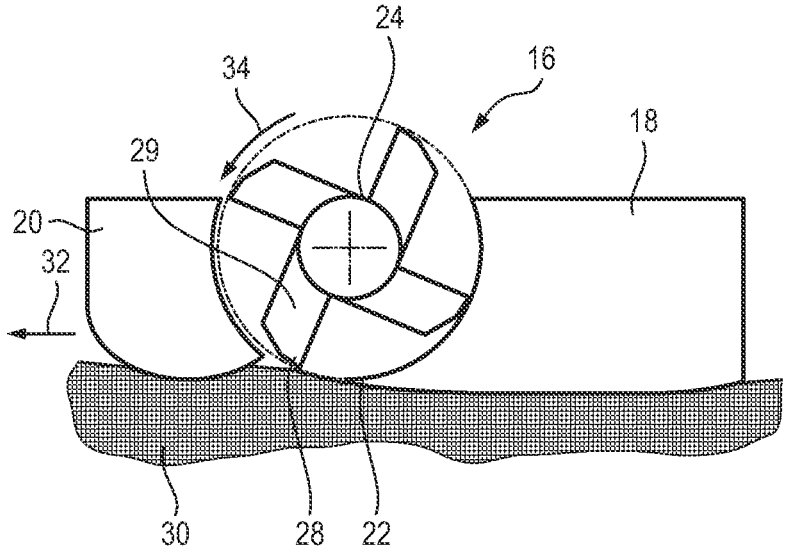
FIG. 2 shows the shaving unit with the guard, cap and drum as moved over a skin.

The overall arrangement of the shaving unit 16 according to FIG. 2 consists of the cutting edge 22 that is moved over the skin 30 with the rotating drum 24 equipped with the counter cutting edges 28 to shear or cut the hairs. To support the cutting edge 22 and guide the shaving unit 16 over the skin, the guard 20 is provided, and the cutting edge 22 is extended into a cap area. As one of the counter cutting edges 28 moves across the cutting edge 22, a cutting line 44 is defined at the crossing line.

The guard 20 may be a closed or open, teethed guard. To improve the skin-flow, a low friction area may be provided on the cap 20, and a relatively higher friction may be provided on the guard 18.

During shaving the shaving unit 16 is moved over the skin 30 into the direction of arrow 32, while the drum 24 with the counter cutting edges 28 rotates in the direction of arrow 34. Up to this point the shaving unit 16 is of conventional design.

Figure 9:
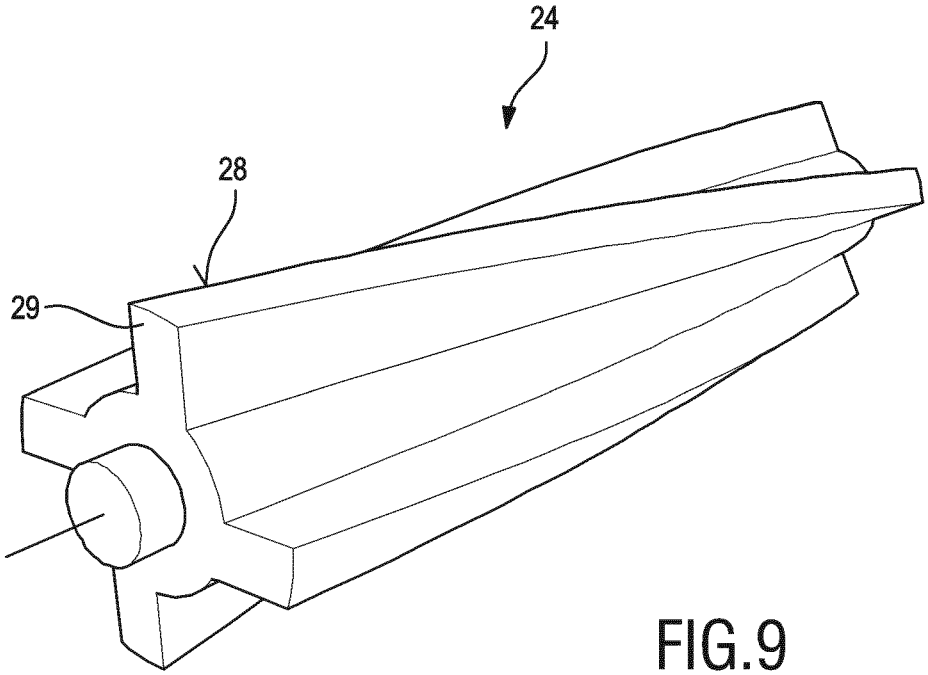
FIG. 9 shows a perspective representation of the drum 24 including four catenary or cantilevered structures 29 that are wound spirally around the outer surface of the drum 24. The counter cutting edges 28 represent the outer surfaces of the catenary or cantilever structures 29.

FIG. 9 shows a perspective representation of the drum 24 including four catenary or cantilevered structures 29 that are would spirally around the outer surface of the drum 24. The counter cutting edges 28 represent the outer surfaces of the catenary or cantilever structures 29.

Figure 3:
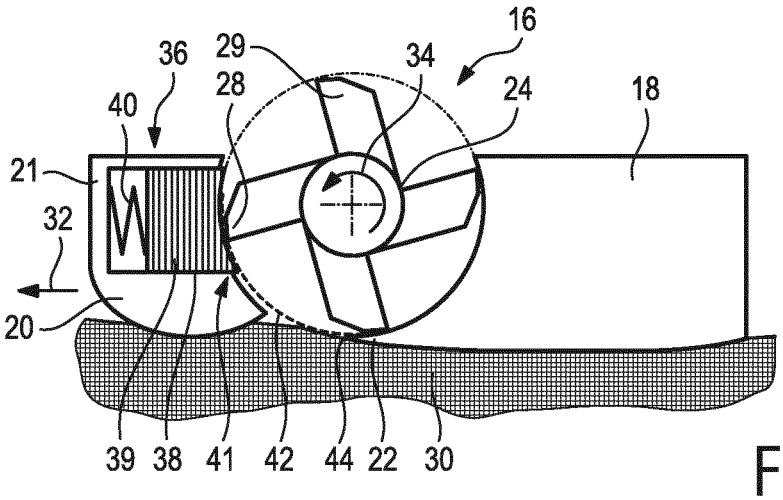
FIG. 3 shows the shaving unit of FIG. 2 including a lubricating arrangement according to the invention for lubricating at least one of the counter cutting edges, not shown in FIGS. 1 and 2.

According to the invention there is provided a lubricating arrangement designated in total with 36 (see FIG. 3, not shown in FIGS. 1 and 2 for ease of representation).

During shaving the shaving unit 16 is moved over the skin 30 by a user. The speed of shaving varies greatly between individuals and can be anywhere between 3 and 300 mm/second. The drum 24 is actively driven. For the cutting function the respective counter cutting edges 28 must be operated at a speed that is larger than the shaving speed. The counter cutting edges 28 and any supporting surface area of the rotating drum 24 thus are generally in sliding contact at a speed greater than 300 mm/second. With a typical shaving speed of 100 mm/second, the relative speed of the counter cutting edges 28 to the skin 30 is in excess of 200 mm/second and typically in 500 mm/second range.

To achieve a close shave, the skin 30 must in close contact and at some pressure with the counter cutting edge 28 in the area immediately in front of the cutting edge 22. Typically this area is not smaller than 0.5 mm, ideally much wider.

According to FIG. 3 the lubricating arrangement 36 comprises a liquid reservoir 38 within which an effusing pad 39 may be arranged. In addition, the effusing pad 39 may be spring-biased into the direction of the drum 24 by a spring element 40. Further there is a feed mechanism designated in total with 41 for supplying lubricant from the liquid reservoir 38 to at least one of the counter cutting edges 28. In its simplest form, the feed mechanism 41 may only comprise the spring element 40 pressing the effusing pad 39 into the direction of the counter cutting edges 28.

The cutting edge 22 has a radius of curvature enabling hair cutting in co-operation with the counter cutting edge 28. Thus it must be "sharp". In particular the radius of curvature of the cutting edge 28 is equal to or smaller than 30 micrometers, more preferably equal to or smaller than 20 micrometers, and most preferably equal to or smaller than 15 micrometers, or in the single digit range of micrometers. The counter cutting edge 28 is the outer skin contacting surface of the drum 24 cooperating with the cutting edge 22 (see FIG. 9) and having a radius of curvature adapted to some extend to the radius of curvature of the cutting edge 22.

Figure 4:
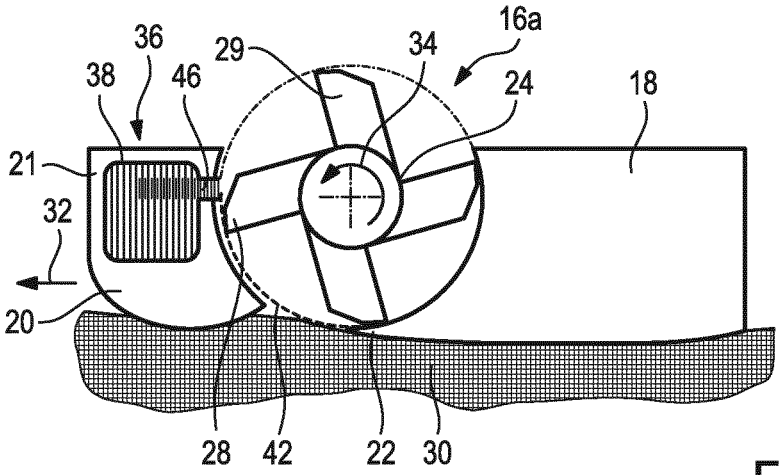
FIG. 4 shows a slightly modified embodiment of the shaving unit of FIG. 3.

According to FIGS. 3 and 4 a lubricating film depicted with 42 is provided by the effusing pad 39 onto one of the counter cutting edges 28 being in contact with the effusing pad 39, before the cutting edge 22 is reached during rotation of the drum 24.

Thus, the lubricating film 42 is applied, before the respective counter cutting edge 28 contacts the skin 30. As a consequence, the lubricating film 42 is immediately applied before the cutting line 44 is reached. Thus, there is a direct lubricating, before the cutting process begins.

The effusing pad 39 for instance may be a stiff felt pad that is infused with a lubricant comprising polyethylene glycol and held within the liquid reservoir 39.

The lubricating arrangement 36 is preferably configured as a consumer replaceable part, a consumable.

It may be configured as a cartridge 21 together with the guard 20, thereby allowing an easy replacement. As mentioned before, the cartridge 21 may be replaceable together with a different part, such as the cutting edge 22 or the drum 24.

In FIG. 4 a slight modification of the shaving unit is shown and depicted in total with reference numeral 16*a*. Apart from that the same reference numerals are used for corresponding parts.

The lubricant arrangement 36 according to FIG. 4 comprises a wick 46 extending from the liquid reservoir 38. In this way the exposed area can be reduced when compared to the overall dimensions of the liquid reservoir 38. The pad 39 according to FIG. 3 extends over the entire width of the drum 24 (typically in the order of 32 mm). The angle of exposure is limited to a minimum, when the pad 39 according to FIG. 3 is replaced by a wick 46, drawing the lubricant out of the reservoir 38, as shown in FIG. 4.

In this case the pad 39 may be dispensed with or may still be present within the liquid reservoir 38, if desired.

Figure 5:
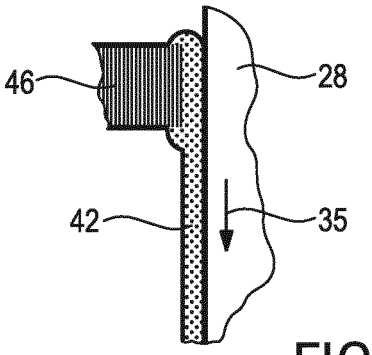
FIG. 5 shows an enlarged representation of the part of the wick providing a lubricating film on one of the counter cutting edges.

As shown in more detail in FIG. 5 the end of the wick 46 leads to the formation of the lubricating film 42 on the respective surface of the counter cutting edge 28 in contact therewith, while the counter cutting edge 28 moves into a tangential direction 35.

To regulate the amount of lubricant transferred onto the counter cutting edges 28, the friction of the lubricating pad 39 or of the wick 46 may be used to regulate the pressure of the wick 46 onto the rotating counter cutting edge 28 in contact with the wick 46. This can be done in several ways. A simple method is to angle the wick 46 resiliently against the direction of movement, namely the tangential direction 35 of the counter cutting edges 28.

Figure 6:
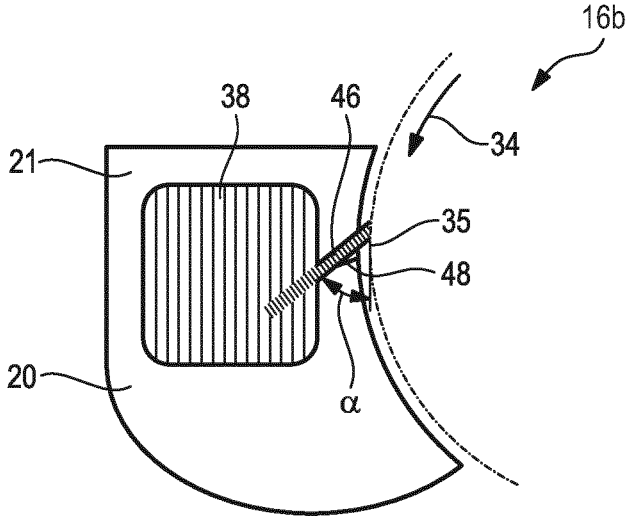
FIG. 6 shows another modification of the shaving unit according to FIG. 4.

This situation is shown in FIG. 6, wherein the shaving unit is depicted in total with 16*b*.

In FIG. 6 the tangential direction of a counter cutting edge 28 being in contact with the wick 46 is depicted with line 35. Between the wick 46 and the tangential direction 35 there is included an acute angle $\alpha$. The wick 46 is spring biased by a wick supporting spring 46 against the surface of the counter cutting edge 28 in contact therewith.

When arranged against the direction of rotation 34 as shown in FIG. 6, the wick 46 resting against the drum 24 or at least over part of its length against one of the counter cutting edges 28 of the rotating drum 24, functions as a belt brake. The friction of the rotating drum 24 or counter cutting edge 28 against the wick 46 deforms the wick 46 and presses it against the rotating part. This will initiate and/or stimulate the flow and transfer of lubricant.

Figure 7:
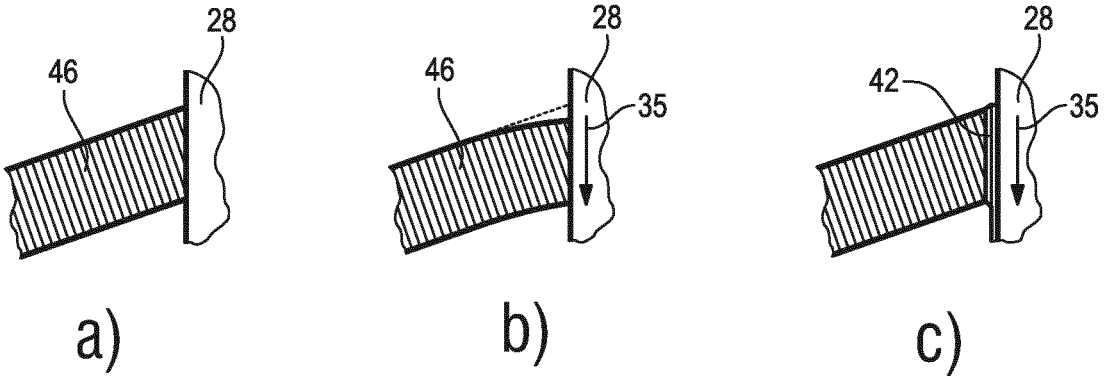
FIG. 7 shows several phases of the wick resting against an end of one counter cutting edge, with a) showing a normal action, b) showing enhanced friction, and c) showing enhanced liquid supply resulting from higher friction.

This situation is shown in FIG. 7.

FIG. 7*a*) shows the initial normal condition. According to FIG. 7*b*) the wick 46 is deformed at its outer end resting against the counter cutting edge 28. By the deformation the pressure on the wick 46 is increased. This leads to an enhancement of liquid flow, leading to an enhancement of the lubricating film 42 shown in FIG. 7*c*).

Thus, the wick 46 resiliently pressed against the counter cutting edge 28 being at least partially in contact therewith leads to a self-regulation of the lubricant feed for supplying a continuous lubricating film 42 prior to contacting the cutting line 44.

Similarly, the friction of the drum 24 against a resilient or movable part (not shown) can be used to regulate or open the flow of lubricant. Also other known methods of controlling lubricant flow can be incorporated. Known are e.g. methods to require skin-contact pressure to engage the fluid or other shaving-related secondary controls.

Figure 8:
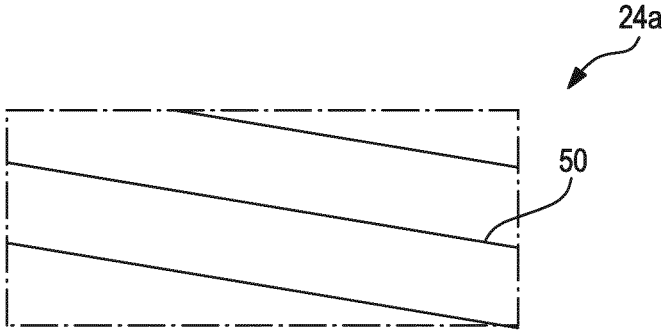
FIG. 8 shows a drum with spirally extending counter cutting edges configured as ridges on the drum.

Many variations of the basic concept described above with respect to the lubricating arrangement 36 exist to which the invention can be applied. This includes also a purely manual control, such as by a push-button or similar control. For example, the counter cutting edges 28 of the drum 24 can be free-standing catenary or cantilever structures as described above or can be configured as ridges 50 on a solid drum configured as a cylinder as shown in FIG. 8.

The counter cutting edges 28 may also be edges of apertures of varying shapes in a hollow tube. Similarly the guard 20 can have a multitude of shapes, as can have the cutting edge area and the adjacent cap area.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope of the invention.

The invention claimed is:

1. A shaving unit coupled to a housing, comprising:

a guard stationary relative to the housing;

a cutting edge arranged at a distance from the guard and stationary relative to the housing;

a hair-entry opening bound by the guard and the cutting edge;

a drum arranged within the housing, the drum being configured to be driven rotatingly about a longitudinal axis thereof;

at least one counter cutting edge arranged on the drum for cooperating with the cutting edge during rotation of the drum about the longitudinal axis for shearing or cutting hairs entering the hair-entry opening; and a lubricating arrangement comprising:

a liquid reservoir configured for receiving a lubricant, and a feed mechanism including a lubricating element arranged adjacent to the drum in a position such as to engage the at least one counter cutting edge during rotation of the drum about the longitudinal axis for providing a lubricating film to the at least one counter cutting edge.

2. The shaving unit of claim 1, wherein the position of the lubricating element is such that, during rotation of the drum about the longitudinal axis, the lubricating element engages the at least one counter cutting edge after the counter cutting edge passing the cutting edge and prior to the counter cutting edge contacting the skin after said passing and before next passing the cutting edge.

3. The shaving unit of claim 1, wherein the liquid reservoir comprises a pad configured for being soaked with the lubricant.

4. The shaving unit of claim 1, wherein the lubricating element comprises a wick being in contact with the liquid reservoir and configured for being soaked with the lubricant from the liquid reservoir.

5. The shaving unit of claim 4, wherein the wick extends from the liquid reservoir towards a path followed by the at least one counter cutting edge during rotation of the drum about the longitudinal axis.

6. The shaving unit of claim 1, wherein the lubricating arrangement comprises a bias spring being arranged for biasing the lubricating element towards the drum.

7. The shaving unit of claim 1, wherein the feed mechanism comprises means for regulating a supply of the lubricant depending on a degree of friction between the lubricating element and the at least one counter cutting edge during rotation of the drum.

8. The shaving unit of claim 4, wherein the wick is arranged at an acute angle relative to a tangential direction of the drum at the position where the wick engages the counter cutting edge during rotation of the drum.

9. The shaving unit of claim 4, wherein the lubricating arrangement further comprises a wick supporting spring for biasing the wick towards the drum.

10. The shaving unit of claim 1, wherein the lubricating arrangement is configured as a replaceable part that can be removed from the shaving unit and replaced by a new lubricating arrangement by a user of the shaving unit.

11. The shaving unit of claim 1, wherein the lubricating arrangement is part of a replaceable cartridge, optionally a replaceable cartridge comprising the guard or the cutting edge.

12. The shaving unit of claim 1, wherein the drum comprises a plurality of counter cutting edges each extending parallel to the longitudinal axis of the drum.

13. The shaving unit of claim 1, wherein the drum comprises a plurality of counter cutting edges arranged on free-standing catenary or cantilevered structures protruding from the drum.

14. The shaving unit of claim 1, wherein the at least one counter cutting edge is configured as a ridge arranged on the drum.

15. A shaving appliance comprising the shaving unit and the housing according to claim 1, the housing configured to be held by a hand.

16. The shaving unit of claim 1, wherein the cutting edge has a radius of curvature of 30 micrometers or less.

17. The shaving unit of claim 1, wherein the drum comprises a plurality of counter cutting edges each extending spirally around the longitudinal axis of the drum.

* * * * *